US009031478B2

(12) United States Patent
Juri et al.

(10) Patent No.: US 9,031,478 B2
(45) Date of Patent: May 12, 2015

(54) DEVELOPING ROLLER INCLUDING A ROUGHENED OUTERMOST SURFACE, AND DEVELOPING DEVICE AND IMAGE FORMING APPARATUS INCLUDING THE SAME

(75) Inventors: Keiichiro Juri, Osaka (JP); Hideaki Yasunaga, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 218 days.

(21) Appl. No.: 13/599,729

(22) Filed: Aug. 30, 2012

(65) Prior Publication Data

US 2013/0058685 A1 Mar. 7, 2013

(30) Foreign Application Priority Data

Sep. 2, 2011 (JP) ..... 2011-191935

(51) Int. Cl.
*G03G 15/08* (2006.01)

(52) U.S. Cl.
CPC .... *G03G 15/0818* (2013.01); *G03G 2215/0863* (2013.01)

(58) Field of Classification Search
CPC ..... G03G 15/0818; G03G 2215/0808; G03G 2215/0863
USPC ..... 399/279, 286
See application file for complete search history.

(56) References Cited

U.S. PATENT DOCUMENTS

| | | | | |
|---|---|---|---|---|
| 5,946,536 | A * | 8/1999 | Suzuki | 399/286 |
| 8,010,023 | B2 * | 8/2011 | Murayama et al. | 399/279 |
| 2005/0078986 | A1 * | 4/2005 | Nakamura et al. | 399/286 |
| 2005/0226659 | A1 * | 10/2005 | Ebe | 399/286 |
| 2008/0226356 | A1 | 9/2008 | Yasunaga et al. | |
| 2009/0148197 | A1 * | 6/2009 | Yamada et al. | 399/286 |
| 2009/0185819 | A1 * | 7/2009 | Aruga et al. | 399/286 |
| 2011/0243616 | A1 | 10/2011 | Nakagawa et al. | |

FOREIGN PATENT DOCUMENTS

| | | |
|---|---|---|
| JP | 06-175476 | 6/1994 |
| JP | 2004-198710 | 7/2004 |

OTHER PUBLICATIONS

Shimadzu Corporation; Nov. 23, 2011; DUH-211/DUH-211S Infosheet from website.*

Korins.com; Sep. 20, 2003; Extracted Hardness Testing Methods sheet from website.*

* cited by examiner

*Primary Examiner* — David Gray

*Assistant Examiner* — Laura Roth

(74) *Attorney, Agent, or Firm* — Oblon, McClelland, Maier & Neustadt, L.L.P.

(57) ABSTRACT

A developing roller includes a core metal and an elastic layer formed on an outer circumference of the core metal. An outermost surface of the developing roller is roughened. A difference between a maximum value and a minimum value of an indentation power of the outermost surface is 10% to 21%, wherein the indentation power is measured by a micro-indentation test at 120 locations spaced 3 degrees apart on a circumference of the developing roller, which is at a center of the developing roller with respect to a longitudinal direction. A developing device and an image forming apparatus each include the developing roller.

14 Claims, 12 Drawing Sheets

DEVELOPING ROLLER INCLUDING A ROUGHENED OUTERMOST SURFACE, AND DEVELOPING DEVICE AND IMAGE FORMING APPARATUS INCLUDING THE SAME

BACKGROUND OF THE INVENTION

1. Field of the Invention

The present invention relates to a developing roller, a developing device, and an image forming apparatus.

2. Description of the Related Art

Low price, space saving and simplified system are sales points of a one-component, contact development type laser printer. For such a printer to obtain a favorable image in a stable manner over a period of time, it has already been known that stable formation of a toner thin layer having uniform charge and uniform quantity on a developing roller which bears the toner thin layer on a surface thereof and rotates to supply a toner to a region being developed has become an important technology.

With a conventional developing roller, however, a toner which has passed a regulating nip abrades a surface of the developing roller as the number of printing increases, which decreases the performance of the developing roller to scrape the toner on the toner layer regulating blade. As a result, the toner is firmly fixed (sealed) on the toner layer regulating blade. One reason for the toner fixing is reduced scraping property of the developing roller, but it is largely affected by the properties of the toner itself. There are toners which are more easily fixed. Once toner fixing occurs, no more toner can pass through the region of the toner fixing, and an image which lacks a toner and appears as a white streak in the image is obtained.

In order to improve the toner fixing on the toner layer regulating blade, various techniques have been proposed. However, many of the proposals involve increased number of parts or complex developing systems. There are not many proposals to solve the problem by the surface profile of a developing roller in a simple system having a developing roller and a toner layer regulating blade.

For example, Japanese Patent Application Laid-Open (JP-A) No. 06-175476 proposes a developing roller having a surface with irregularity, where the irregularity includes asymmetric inclinations which recede with respect to the direction of rotation. This enables uniform and sufficient delivery of a toner and reduction of the contact area between a photoconductor and the toner, resulting in life extension.

However, the concave portion of the surface of the developing roller in this proposed technology is characterized in having a front rake face and a rear flank face in order to ensure raking and retaining of a toner, where the raking face rises at a sharp angle toward an upstream side with respect to the direction of rotation, and where the flank face is shallowly inclined from the downstream side with respect to the direction of rotation so that it smoothly contacts a surface of a latent image of the photoconductor to release the toner toward the downstream side with respect to the direction of rotation. This technology cannot solve the problem of a toner firmly fixed on a toner layer regulating blade.

SUMMARY OF THE INVENTION

An object of the present invention is to provide: a developing roller that suppresses toner fixing on a toner layer regulating blade and forms a high-quality image in a stable manner even for a toner having superior fixing property without involving increased number of parts or complex system; a developing device and an image forming apparatus which include the developing roller.

The means for solving the above problems are as follows. That is:

a developing roller according to the present invention is one having a core metal and an elastic layer around the outer circumference of the core metal, wherein an outermost surface of the developing roller is roughened, and wherein a difference between a maximum value and a minimum value of indentation power is 10% to 21%, wherein the indentation power is measured by a micro-indentation test at 120 locations with 3 degrees apart on a circumference of the developing roller, which is at a center of the developing roller with respect to a longitudinal direction.

The present invention makes it possible to solve the above conventional problems, attain the above objects, and provide a developing roller that suppresses toner fixing on a toner layer regulating blade and forms a high-quality image in a stable manner even for a toner having superior fixing property without involving increased number of parts or complex system; a developing device and an image forming apparatus which include the developing roller.

DETAILED DESCRIPTION OF THE INVENTION

Developing Roller

Figure 1:
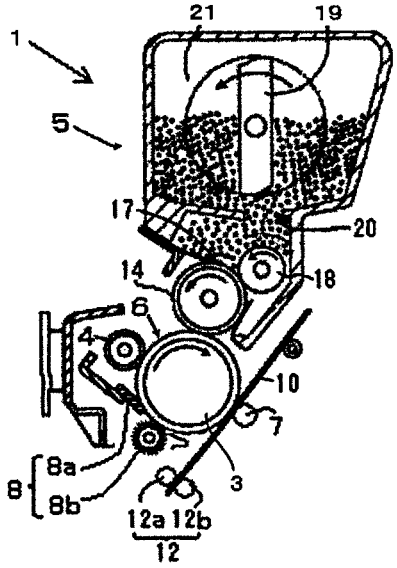
FIG. 1 is a diagram illustrating an example of an image forming apparatus which is equipped with a developing roller of the present invention.

A developing roller according to the present invention includes: a core metal; and an elastic layer formed on an outer circumference of the core metal; and further includes a surface layer and other layers, if necessary.

In the present invention, a difference between a maximum value and a minimum value of indentation power is 10% to 21%, and preferably 15% to 20%, wherein the indentation power is measured by a micro-indentation test at 120 locations with 3 degrees apart on a circumference of a developing roller, which is at a center of the developing roller with respect to a longitudinal direction. When the difference is less than 10%, toner delivery performance tends to degrade. When the difference exceeds 21%, the toner tends to fix on a regulating blade.

The indentation power may be measured using, for example, Dynamic Ultra Micro Hardness Tester (DUH-211, manufactured by Shimadzu Corporation). The indentation power of 100% means the same amount as that indented is restored.

The outermost surface of the developing roller is roughened. Because the outermost surface of the developing roller is roughened, a concave portion is formed on the outermost surface of the developing roller, for example.

The outermost surface of the developing roller observed from a cross-section perpendicular to an axis direction of the core metal includes a plurality of concave portion with respect to the outermost surface, in at least two of the concave portions adjacent with each other, a first inclined surface and a second inclined surface which is larger than the first surface is alternatively and iteratively allocated, and it is preferable that an average length of the first inclined surface is shorter than an average length of the second inclined surface.

It is preferable that the first inclined surface in the concave portion is on the upstream side with respect to a rotating direction of the developing roller and that the second inclined surface in the concave portion is on the downstream side with respect to the rotating direction of the developing roller.

The surface shape of the developing roller may be measured by obtaining a surface profile of the surface of the developing roller using a laser microscope.

The shortest distance between centers of adjacent concave portions (pitch) is not particularly restricted and may be appropriately selected depending on the purpose, and an average value thereof is preferably 100 μm to 250 μm, and more preferably 150 μm to 230 μm.

The center of a concave portion means a portion where the most depressed portion in a surface profile obtained by a laser microscope.

A depth of the concave portion (maximum difference in height) is not particularly restricted and may be appropriately selected depending on the purpose, and an average value thereof is preferably 11.0 μm to 15.0 μm.

The shortest distance between the centers of adjacent concave portions and the depth of the concave portion may be measured by obtaining a surface profile of a surface of the developing roller using, for example, a laser microscope.

A developing roller of the present invention includes concave portions on an outermost surface thereof, which enhances an action that the concave portions scrape a toner by sliding and rubbing a tip portion of a toner layer regulating blade. In addition to toner transporting ability to a developing region, it is important for the developing roller to be able to slide and rub the toner layer regulating blade while hardly scratching it, or to have a shape, structure and property which relate to self-durability. Especially, at lease two adjacent concave portions are structured such that a first inclined surface and a second inclined surface larger than the first surface are alternatively and iteratively allocated and that an average length of the first surface is shorter than an average length of the second surface, which enhances an action of the concave portions to slide and rub a tip of a toner layer regulating blade and to scrape the toner.

For an elastic layer of the developing roller, hardness that enables scraping of a toner, elasticity and resilience that retains its shape that a toner layer regulating blade is not damaged, and toughness that ensures high durability are required at the same time. As described later, the elastic layer preferably includes 50% by mass or more of epichlorohydrin (ECO), acrylonitrile butadiene rubber (NBR) or chloroprene rubber (CR).

<Core Metal>

The shape, structure, size and material of the core metal are not particularly restricted and can be appropriately selected depending on the purpose. For example, the shape may be cylindrical, columnar or rod-shaped. The structure includes a single-layered structure or a laminated structure, and the size may be appropriately selected in accordance with the size of a developing roller.

The material of the core metal is not particularly restricted and can be appropriately selected depending on the purpose, and it may be appropriately selected from, for example, metals, carbon steel, alloy steels, cast iron or electrically-conductive resins. Examples of the metals include aluminum, iron and copper. Examples of the alloy steels include brass, stainless steel, nickel-chromium steel, nickel-chromium-molybdenum steel, chromium steel, chromium-molybdenum steel and nitride steel to which Al, Cr, Mo and V are added.

Here, as a measure to prevent corrosion, the material of the core metal may be plated or oxidatively-treated. The plating may be electroplating or electroless plating, and electroless plating is preferable in view of dimensional stability.

<Elastic Layer>

The elastic layer contains an elastic material, and it further contains an electrically-conductive agent and other components, if necessary.

The elastic layer preferably exhibits an electric conductivity of $10^{10}$ Ω·cm or less in volume resistance.

—Elastic Material—

The elastic material is not particularly restricted and can be appropriately selected depending on the purpose. Examples thereof include silicon rubber, ethylene-propylene-diene rubber (EPDM), polyurethane rubber, chloroprene rubber (CR), natural rubber, butyl rubber, polyisoprene rubber, polybutadiene rubber, styrene-butadiene rubber, nitrile rubber, ethylene-propylene rubber, acrylic rubber, acrylonitrilebutadiene rubber (NBR), epichlorohydrin rubber (ECO), fluorine-containing rubber, and rubber or elastomer including a mixture thereof. These may be used alone or as a combination of two or more kinds.

It is also possible to use a dual structure that, for example, nitrile rubber is laminated on a cylinder of styrene rubber.

Among them, epichlorohydrin rubber (ECO), acrylonitrilebutadiene rubber (NBR) and chloroprene rubber (CR) are particularly preferable.

—Electrically-Conductive Agent—

The electrically-conductive agent is not particularly restricted and can be appropriately selected depending on the purpose. For example, an ion-conductive agent or an electron-conductive agent is used.

The ion-conductive agent is not particularly restricted and can be appropriately selected depending on the purpose. Examples thereof include: inorganic ion-conductive agents such as sodium perchlorate, lithium perchlorate, calcium perchlorate and lithium chloride; and organic ion-conductive agents such as modified fatty acid dimethylammonium ethylsulfate, stearic acid ammonium acetate, lauric acid ammonium acetate and octadecyl trimethylammonium perchlorate.

The electron-conductive agent is not particularly restricted and can be appropriately selected depending on the purpose. Examples thereof include: electrically-conductive carbon such as ketjen black and acetylene black; carbon for rubber such as SAE ISAF, HAF, FEF, GPF, SRF, FT, and MT; carbon for ink subjected to oxidation treatment, pyrolytic carbon, natural graphite, and artificial graphite; electrically-conductive metallic oxide such as tin oxide, titanium oxide, and zinc oxide; and metal such as nickel, copper, silver, and germanium. Those may be used alone or as a combination of two or more kinds.

The quantity of an electrically-conductive agent to be added is not particularly restricted and can be appropriately selected depending on the purpose. In the case of an ion-conductive agent, the quantity thereof is preferably 0.01 parts by mass to 5 parts by mass and more preferably 0.05 parts by mass to 2 parts by mass relative to 100 parts by mass of the elastic material. In the case of an electron-conductive agent, the quantity thereof is preferably 1 part by mass to 50 parts by mass and more preferably 5 parts by mass to 40 parts by mass relative to 100 parts by mass of the elastic material.

—Other Components—

Examples of the other components include a crosslinking agent, a vulcanizer, a vulcanizing aid, a vulcanization accelerator, a vulcanization retardant, a foaming agent, a softener, an adhesion imparting agent, an adhesion preventing agent, a releasing agent, a coloring agent, a processing aid, an anti-aging agent, a filler, and a reinforcing agent.

A JIS-A hardness of the elastic layer is not particularly restricted and may be appropriately selected depending on the purpose, and it is preferably 30° to 45° in view of satisfying easily and reliably various properties such as flexibility which enables sufficient contacting and fitting to a surface of a toner layer regulating blade and elasticity which contributes to hardness, toughness and resilience. When the JIS-A hardness is less than 30°, the hardness is too small, and the toner scraping property may decrease. When it exceeds 45°, the hardness of the elastic layer is too large, and it may be difficult to adjust the difference between the indentation power values of a surface layer within a desired range.

The JIS-A hardness may be measured, for example, by a type-A durometer in conformity with JIS K6253 "Rubber, vulcanized or thermoplastic-Determination of hardness".

The average thickness of the elastic layer is not particularly restricted and can be appropriately selected depending on the purpose. A preferable average thickness thereof is, for example, 1 mm to 10 mm.

<Surface Layer>

The surface layer contains a resin and further contains an electrically-conductive material, organic spherical particles, and other components, if necessary.

<<Resin<<

The resin is not particularly restricted and can be appropriately selected depending on the purpose. Examples thereof include: a fluorine resin, a silicone resin, a polyurethane resin and an acrylic resin. Among these, a polyurethane resin is particularly preferable.

—Polyurethane Resin—

The polyurethane resin means a polymer formed of a diisocyanate compound and a diol compound, whose main chain is composed mainly of a polyurethane skeleton having a series of urethane bonds.

The diisocyanate compound is not particularly restricted and can be appropriately selected depending on the purpose. Examples thereof include: aliphatic diisocyanate compounds such as hexamethylene diisocyanate and 2,2,4-trimethylhexamethylene diisocyanate; alicyclic diisocyanate compounds such as isophorone diisocyanate, hydrogenated xylylene diisocyanate, 1,4-cyclohexane diisocyanate and 4,4'-dicyclohexylmethane diisocyanate; aromatic-aliphatic diisocyanate compounds such as xylylene diisocyanate and tetramethylxylene diisocyanate; aromatic diisocyanate compounds such as toluylene diisocyanate and phenylmethane diisocyanate; and modified compounds of these diisocyanates (modified compounds including carbodiimide, uretdione or uretimine).

The diol compound is not particularly restricted and can be appropriately selected depending on the purpose. Examples thereof include: polyethylene glycol; polypropylene glycol; polyether diols such as polytetramethylene ether glycol and polyhexamethylene ether glycol; polyester diols such as polyethylene adipate, polybutylene adipate, polyneopentyl adipate, poly-3-methylpentyl adipate, polyethylene/butylene adipate and polyneopentyllhexyl adipate; polylactone diols such as polycaprolactone diols; and polycarbonate diols.

A method for synthesizing the polyurethane resin is not particularly restricted and can be appropriately selected depending on the purpose. Examples thereof include a solution technique, a prepolymer technique and a hot melt technique.

<<Electrically-Conductive Material>>

The electrically-conductive material is not particularly restricted and can be appropriately selected depending on the purpose. Examples thereof include: electrically-conductive carbons such as ketjen black EC and acetylene black; carbons for rubber such as SAF, ISAF, HAF, FEF, GPF, SRF, FT, and MT; carbon for coloring subjected to oxidation treatment and pyrolytic carbon; metals and metallic oxides such as indium doped tin oxide (ITO), tin oxide, titanium oxide, zinc oxide, copper, silver, and germanium; and electrically-conductive polymers such as polyaniline, polypyrrole, and polyacetylene. These may be used alone or as a combination of two or more kinds.

A content of the electrically-conductive material in the surface layer is not particularly restricted and can be appropriately selected depending on the purpose. The content is preferably 1 part by mass to 50 parts by mass and more preferably 5 parts by mass to 40 parts by mass relative to 100 parts by mass of the resin.

<<Organic Spherical Particles>>

Examples of the organic spherical particles include: composite spherical particles such as polytetrafluoroethylene, polystyrene polymer, polyethylene polymer, polypropyrene polymer, urea-formalin polymer, silicone polymer, polymethylmethacrylate (PMMA) and melamine-silica; and spherical particles of condensation polymers such as melamine-formaldehyde polymer, polyester and polycarbonate.

A volume average particle size of the organic spherical particles is not particularly restricted and can be appropriately selected depending on the purpose. The volume average particle size is preferably 3 μm to 10 μm.

When the volume average particle size is less than 3 μm, it may be difficult to convey a toner since a portion exposed from a surface is too small. When it exceeds 10 μm, a portion exposed from a surface is too large, where a toner may accumulate.

The volume average particle size may be measures by heretofore known methods such as laser diffraction particle size analyzer based on laser diffraction light scattering technology.

The organic spherical particles preferably have a part thereof exposed from a surface since it supports improvement of toner scraping property.

A content of the organic spherical particles in the surface layer is preferably 5% by mass to 50% by mass, and more preferably 10% by mass to 40% by mass.

<<Other Components>>

Examples of the other components include a solvent, a softener, a processing aid, an anti-aging agent, a filler, a reinforcing agent, and a lubricant.

The solvent is not particularly restricted and can be appropriately selected depending on the purpose. Examples of the solvent include: ketone solvents such as acetone, methyl ethyl ketone, and cyclohexanone; aromatic hydrocarbon solvents such as toluene and xylene; aliphatic hydrocarbon solvents such as hexane; alicyclic hydrocarbon solvents such as cyclohexane; ester solvents such as ethyl acetate and butyl acetate; ether solvents such as isopropyl ether and tetrahydrofuran; amide solvents such as dimethyl sulfoamide; halogenated hydrocarbon solvents such as chloroform and dichloroethane; and a mixture of these solvents.

A method for forming the surface layer is not particularly restricted and can be appropriately selected depending on the purpose. One example of the method is a method of dissolving or dispersing a resin, an electrically-conductive material, organic spherical particles and other components in a solvent; coating an elastic layer with the mixture by, for example, a dipping method, a roll coater method, a doctor blade method or a splaying method; and reacting and hardening them by drying them at an ordinary temperature or a high temperature of about 50° C. to about 170° C.

An average thickness of the surface layer is not particularly restricted and can be appropriately selected depending on the purpose. For example, the average thickness thereof is preferably 1 μm to 100 μm and more preferably 5 μm to 30 μm.

Figure 2:
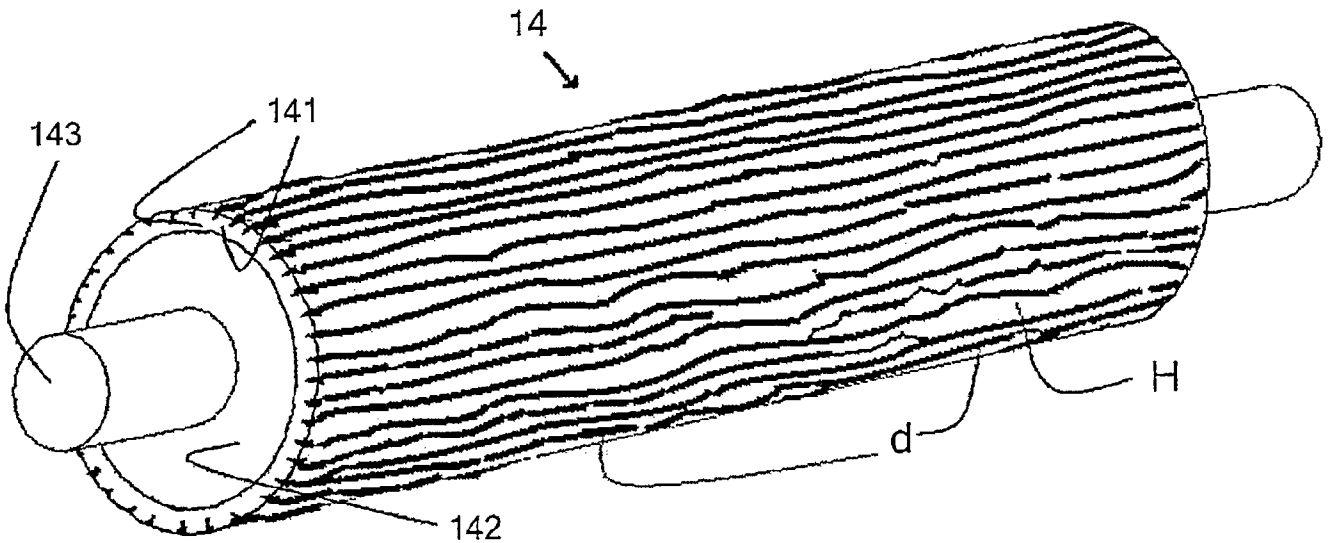
FIG. 2 is a diagram explaining an example of a developing roller of the present invention.

FIG. 2 illustrates one example of a developing roller of the present invention. This developing roller 14 includes an electrically-conductive elastic layer 142 at a circumference of a core metal 143. In FIG. 2, a reference mark 141 denotes a surface layer.

In this exemplary developing roller 14, striped convex portions H are alternatively allocated between valley-like or trough-like concave portions "d" which substantially follow an axis direction of the core metal 143 on a surface of the elastic layer 142 as "undulatory concavo-convex portions inclined in a circumferential direction", and the convex portions "H" have minute undulations. The concave portions "d" are not restricted to long and thin valley-like or trough-like geometry and may be, for example, pore geometry illustrated hereinafter.

Figure 3:
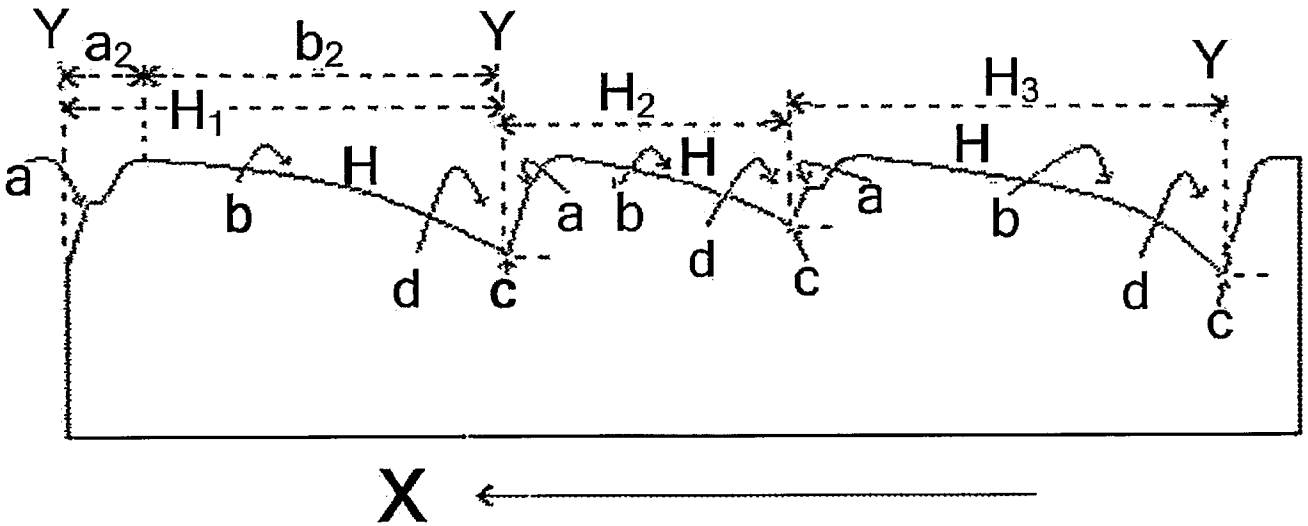
FIG. 3 is a diagram explaining a cross-section of an example of a concave portion included in an outermost surface of a developing roller.

Furthermore, as illustrated in FIG. 3, among surfaces which constitute a convex portion "H" of the concavo-convex portion, a front first surface "a" with respect to the direction of rotation of the roller denoted by an arrow "X" includes a steep slope which rises relatively sharply from a root "c" of a concave portion "d" to a peak toward a downstream side of the direction of rotation; a second inclined surface "b" behind the first inclined surface includes a slope which gently descends toward a downstream side of the direction of rotation; and a tail edge constitutes a wall of the rear concave portion "d".

As observed in the first inclined surfaces "a", second from the right or first from the left in FIG. 3, the first inclined surface "a" may have an uneven surface. In this way, the first surface "a" of the outermost surface of the developing roller inclines toward a top of a convex portion. Among the first inclined surface "a" and the second inclined surface "b", the first inclined surface "a" which comes into contact first with the blade is steep (forms a smaller angle with a normal line "Y"). This is, in other words, an average length $a_2$ of the first inclined surface is shorter than an average length $b_2$ of the second inclined surface.

Figure 4:
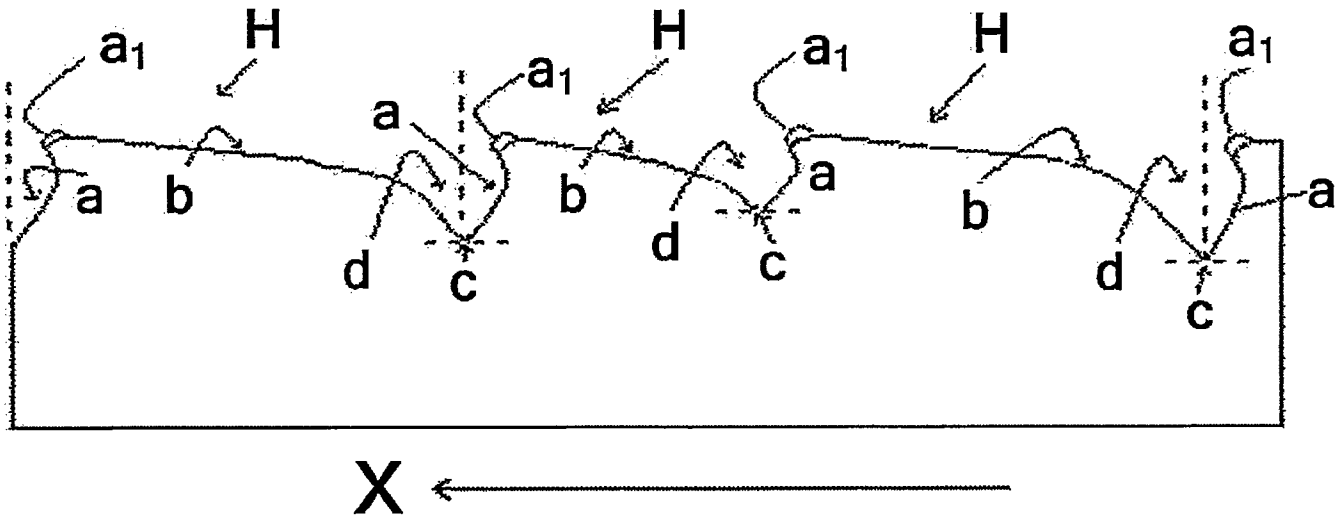
FIG. 4 is a diagram explaining a cross-section of another example of a concave portion included in an outermost surface of a developing roller.

Also, the first inclined surface "a" and the second inclined surface "b" of the outermost surface of the developing roller are not necessarily flat. As illustrated in FIG. 4, it may be curved downward as the first inclined surface "a" or curved upward as the second inclined layer "b"; it is not particularly restricted in the present invention as long as an object that concave portions have toner retention capability within a certain range while rotating and scrapes off a toner which has been fixed to a toner layer regulating blade is achieved. For this object, an action of the second inclined surface "b" which supports the first inclined surface "a" in the back and supports elasticity and resilience thereof is also important.

Furthermore, a top "$a_1$" of the first inclined surface "a" illustrated in FIG. 4 is formed by deformation and displacement (burr, etc.) of a material during preparation of concave portions, and the top "$a_1$" of the first inclined surface "a" is also effective for sufficient contact to as well as sliding and rubbing of a toner layer regulating blade.

Accordingly, it is possible that the top "$a_1$" of the first inclined surface "a" turned upward is formed by deformation of a material during processing and that the top "$a_1$" is further cured by crosslinking of a crosslinking material added to a material for the surface layer.

Also, even though concave portions are partly striped, these stripes are not necessarily in a direction along an axis direction of the roller as long as they are allocated in an oblique direction (a direction which is not perpendicular to the axis).

Further, for developing rollers that valley-like or streaky concave portions are allocated between convex portions, illustrated in FIG. 2 to FIG. 4, an average value of the shortest distance between the centers of adjacent concave portions (pitch) is preferably 100 μm to 250 μm. Also, an average value of a depth of the concave portion (the maximum difference in height) is preferably 11.0 μm to 15.0 μm.

The depth "d" of the concave portion contributes to flexibility such that the first inclined surface "a" of the convex portion "H" contacts well with a surface of the toner layer regulating blade. Also, the shortest distance between the centers of adjacent concave portions guarantees an appropriate action of the second inclined surface which supports the first inclined surface "a" in the back and supports elasticity and resilience thereof. Here, as it is understood from FIG. 3 and FIG. 4, the shortest distance between the centers of adjacent concave portions and the depth of the concave portions are not uniform but have variation, and thus average values of intervals and differences in height, respectively, are considered.

Concave portions on an outermost surface of a developing roller of the present invention are not necessarily streaky or striped. In fact, as shown in specific examples hereinafter, each concave portion may be an independent pore when the concave portions are formed on a surface using a grindstone or by a sandblast method. A top "$a_1$" of a first surface "a" in an upstream direction of a direction of rotation of the development roller formed with such a processing method may be slightly raised, probably because of deformation due to viscoelasticity of a material of the outermost surface (material displacement) as illustrated in FIG. 4. As a result, many of them have enhanced ability to scrape off a toner fixed to the blade.

Figure 5:
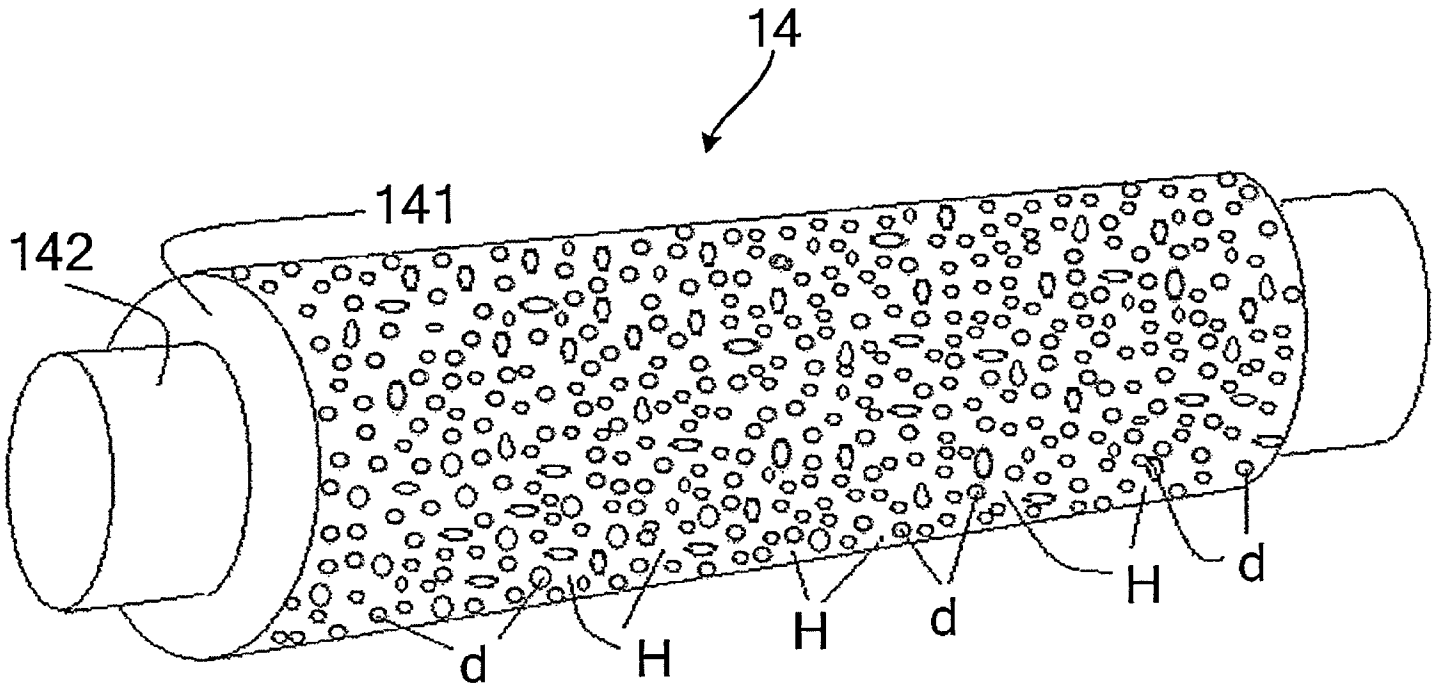
FIG. 5 is a diagram explaining another example of a developing roller of the present invention.

FIG. 5 illustrates another example of a developing roller of the present invention. In this developing roller of FIG. 5, concave portions "d" are distributed independently in a random manner like islands in a sea of a convex portion "H". This type of a developing roller may be obtained by, for example, a sandblast treatment from an acute oblique direction with respect to a surface of a surface layer 141 on an elastic layer 142.

Figure 6:
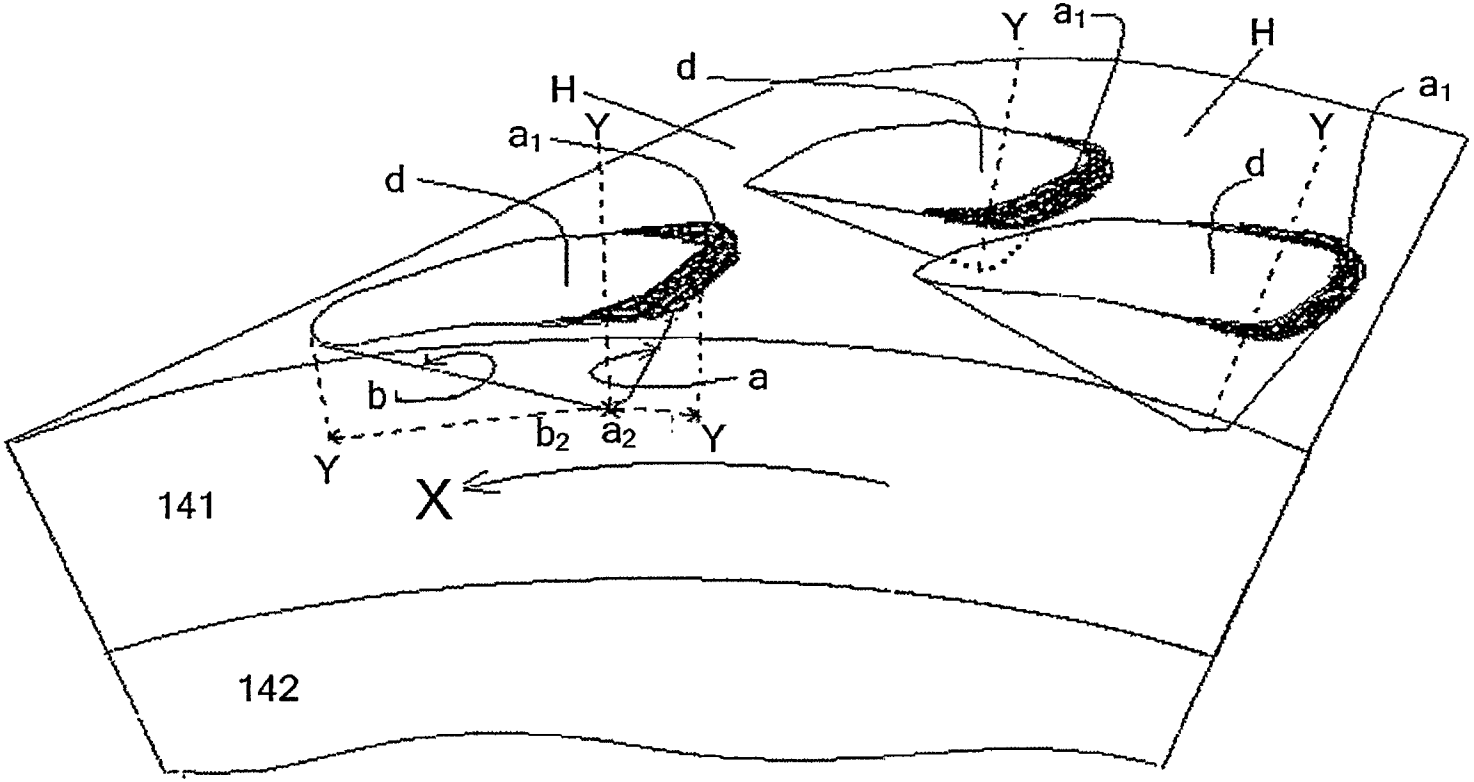
FIG. 6 is a diagram explaining a cross-section of an example of a concave portion included in an outermost surface of a developing roller of FIG. 5.

FIG. 6 illustrates one example of concave portions "d" of an outermost surface of the developing roller of FIG. 5.

Figure 7:
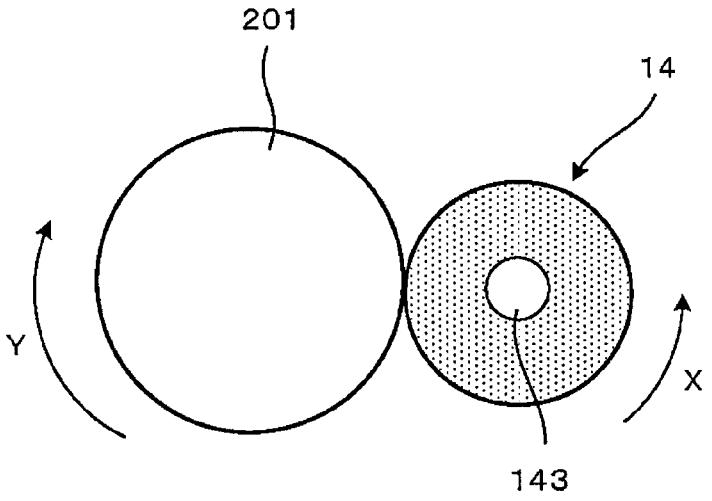
FIG. 7 is a diagram illustrating an example for preparing a developing roller of the present invention.

FIG. 7 is a diagram illustrating an example of a method for preparing a developing roller of the present invention.

In FIG. 7, reference marks 14, 143, X, 201 and Y denote a developing roller, a core metal, a direction of rotation of the developing roller, a grindstone and a direction of rotation of the grindstone, respectively. The direction of rotation Y of the grindstone 201 is always in one direction.

As a first aspect, the developing roller 14 itself does not rotate. In FIG. 7, where the developing roller 14 rotates in conjunction with the rotation of the grindstone 201, the developing roller rotates in a counterclockwise direction.

As a second aspect, the developing roller 14 does not follow the rotation of the grindstone 201. The developing roller rotates itself or is suppressed, and the roller rotates in an opposite direction or rotates at a significantly different speed.

Usually, grinding "with the grain" means grinding that grinding marks are in the same direction as the direction of rotation of the grindstone.

Grinding "against the grain" means grinding that grinding marks are in an opposite direction from the direction of rotation of the grindstone. However, in the present invention, the grinding marks are not restricted to these ordinary definitions. Rather, "with the grain" means that the direction of rotation of a developing roller during preparation of concave portions is the same as the direction of rotation of the developing roller used in developing, and "against the grain" means that the direction of rotation of a developing roller during preparation of concave portions is opposite to the direction of rotation of the developing roller used in developing.

Concave portions on an outermost surface of a developing roller of the present invention are, for example, formed by grinding a surface of an elastic layer such that grinding marks are against the grain, but they are not limited thereto.

Figure 8A:
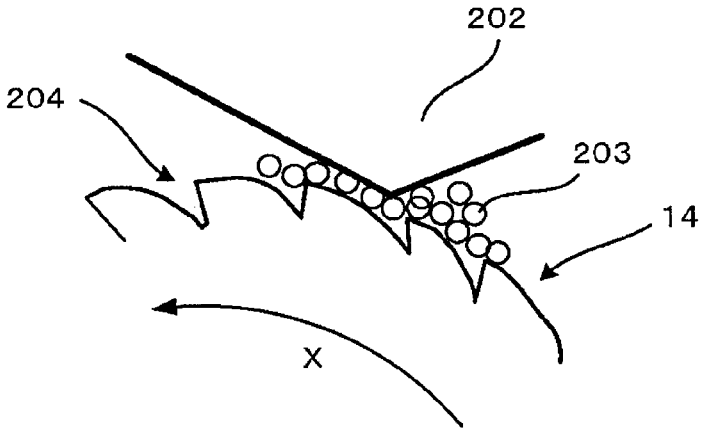
FIG. 8A is a diagram explaining toner scraping performance of a toner layer regulating blade when ground against the grain.
Figure 8B:
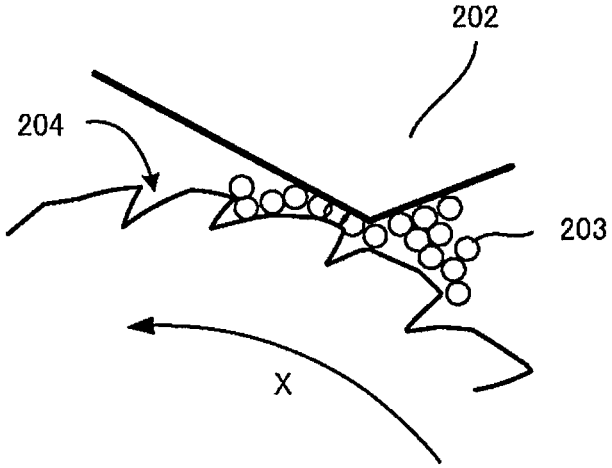
FIG. 8B is a diagram explaining toner scraping performance of a toner layer regulating blade when ground with the grain.

FIG. 8A and FIG. 8B are diagrams explaining the difference in terms of toner scraping performance due to different grinding marks.

FIG. 8A illustrates a case of against-the-grain grinding. Concave portions 204 on an outermost surface of a developing roller 14 (undulations inclined in a circumferential direction) can convey a toner 203 in a stable manner as well as scrape the toner accumulated at a toner layer regulating blade 202. A reference mark "X" denotes a direction of rotation of the developing roller.

FIG. 8A illustrates a case of with-the-grain grinding. Concave portions 204 on an outermost surface of a developing roller 14 (undulations inclined in a circumferential direction) is formed such that they incline in a direction opposite to a circumferential direction of the developing roller. In this case, toner conveyance is stabilized, but scraping of a toner 203 on a toner layer regulating blade 202 degrades. A reference mark "X" denotes a direction of rotation of the developing roller.

Figure 9A:
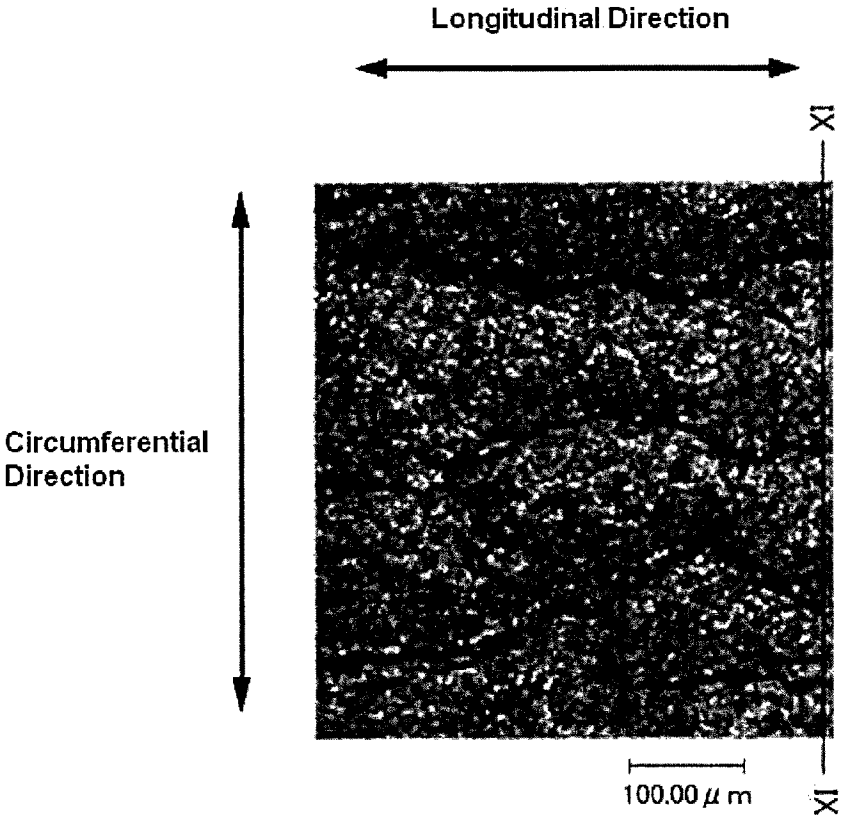
FIG. 9A is a surface observation image of a developing roller by means of a laser microscope.

FIG. 9A is a surface observation image of a developing roller by means of a laser microscope.

Figure 9B:
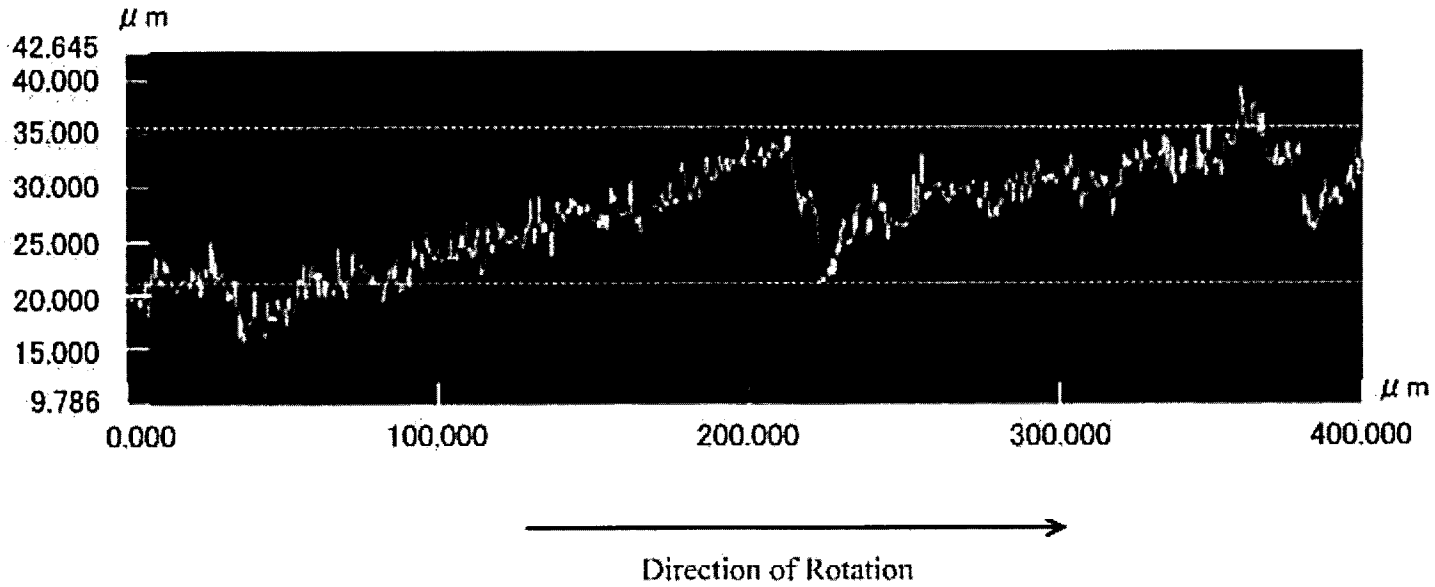
FIG. 9B is an image illustrating a surface profile along the IX-IX line in FIG. 9A of the developing roller by means of a laser microscope.

FIG. 9B is an image illustrating a surface profile along the IX-IX line in FIG. 9A of the developing roller by means of a laser microscope.

FIG. 9A is a surface observation image of a developing roller observed with a laser microscope (VK-9500, manufactured by Keyence Corporation), and FIG. 9B is a resultant data chart of the surface profile measurement along the IX-IX line in FIG. 9A. From the results of FIG. 9A and FIG. 9B, a typical profile of a first inclined surface "a", a second inclined surface "b" and a concave portion "d" which is formed with front and rear ends of the first and second inclined surfaces "a" and "b" is well understood.

Figure 10A:
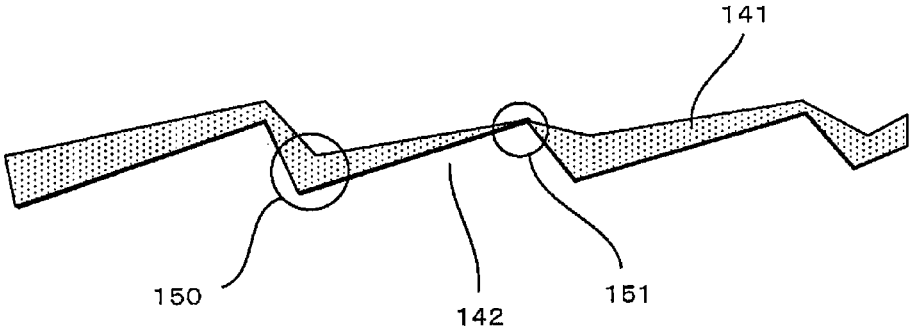
FIG. 10A is a diagram explaining a method to allocate selectively a high elastic region and a low elastic region of a developing roller.
Figure 10B:
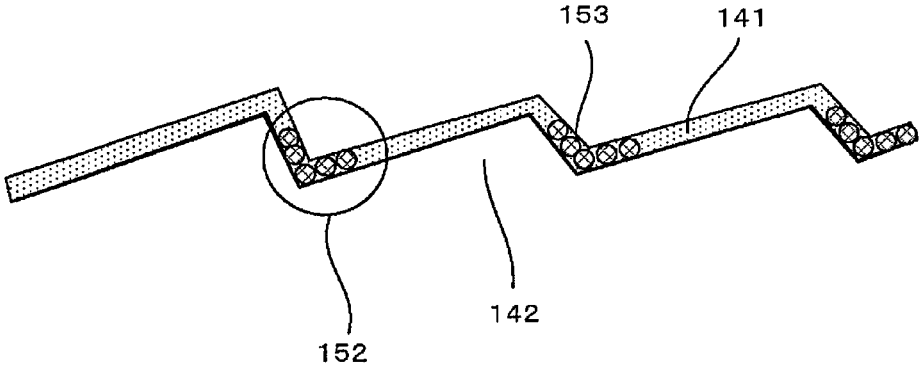
FIG. 10B is another diagram explaining a method to allocate selectively a high elastic region and a low elastic region of a developing roller.

A developing roller of the present invention may be obtained with other surface shapes. FIG. 10A and FIG. 10B are diagrams explaining a method to allocate selectively a high elastic region and a low elastic region of a developing roller. These are to form selectively a portion with large elasticity and a portion with small elasticity in addition to the concave portion. This is achieved by, as illustrated in FIG. 10A, for example, allocating selectively a surface layer 141 on an elastic layer 142 such that the surface layer 141 has various thicknesses as in a region 150 and a region 151.

As illustrated in FIG. 10B, in addition to the concavo-convex portions, a portion having a large hardness and a portion having a small hardness are selectively formed in a surface layer 141 on an elastic layer 142. This is achieved by allocating selectively a region having an elasticity varied by means of a region 152 that organic spherical particles 153 are selectively distributed in an uneven manner in the surface layer 141.

Minute undulatory concavo-convex portions (having an interval of around 100 μm to 250 μm) inclined in a circumferential direction are formed on a surface of a developing roller when the developing roller is ground such that the grinding marks of the developing roller are against the grain with respect to a direction of rotation of a grindstone. A toner accumulated on a regulating blade may be scraped when the convex portions pass a regulating nip. Further, by making the convex and concave portions of each undulation different in terms of elasticity (the convex portion has higher elasticity), the convex portion rubbed and depressed during passing through the regulating nip recovers due to high elasticity, and it is possible to maintain a certain level of toner scraping ability even after duration.

In short, in order to increase scraping performance to a toner layer regulating blade, a developing roller is provided, wherein the developing roller includes surface concavo-convex shapes which have advantageous toner scraping property due to difference in a direction of grinding, and wherein the fixing property of the developing roller does not degrade over duration since the developing roller has difference in terms of elasticity in each surface concavo-convex shape.

The concave portion of the elastic layer may be prepared by:

forming a surface layer by setting up the core metal having the ground elastic layer in a vertical direction, rotating it in a direction of inclination of the concavo-convex portions, and spray coating the core metal having the ground elastic layer with a surface layer solution dissolved in a low-boiling solvent, or by placing the core metal having the ground elastic layer in a horizontal direction, and spray coating the core metal having the ground elastic layer in a longitudinal direction with a surface layer solution including the organic spherical particles; and then baking while rotating the core metal having the elastic layer with the surface layer coated thereon in a direction of inclination of the concavo-convex portions.

The low-boiling solvent is a solvent having a low boiling point, and such a solvent which dries relatively quickly even at a room temperature is used. Examples thereof include acetone, dimethyl ether and ethyl acetate. When two types of solvents, namely ethyl acetate and butyl acetate, are used as a solvent, the ethyl acetate assumes a role of providing fast-drying property to a surface layer. Butyl acetate assumes a role of improving flatness of the film surface since butyl acetate has a higher boiling point than ethyl acetate.

(Developing Device)

A developing device according to the present invention includes: a developing roller configured to bear on a surface thereof a toner to be supplied to a latent image bearing member; a toner supplying member configured to supply the toner onto the surface of the developing roller; a toner layer regulating member configured to form a thin layer of the toner on the surface of the developing roller; and a toner container which houses the toner; and further includes other units, if necessary.

As the developing roller, a developing roller according to the present invention is used.

—Toner Supplying Member—

The toner supplying member is not particularly restricted as long as it is a member configured to supply a toner onto the surface of a toner bearing member and can be appropriately selected depending on the purpose. An example thereof is a feed roller.

—Toner Layer Regulating Member—

The toner layer regulating member: is a member to regulate the quantity of a toner attached onto the developing roller; is formed by using a metal plate spring material including stainless steel (SUS) or phosphor bronze and abutting the free end side to the developing roller surface at a predetermined pressing force; and forms the toner having passed through under the pressing force into a thin layer.

The toner layer regulating member is usually provided at a position lower than a position where the feed roller and the developing roller come into contact with each other.

—Toner Container—

The toner container is not particularly restricted as long as it is a member that can house a toner and can be appropriately selected depending on the purpose.

(Image Forming Apparatus)

An image forming apparatus according to the present invention includes at least: a latent image bearing member; a charging unit; an exposing unit; a developing unit; a transfer unit; and a fixing unit, and further includes other units appropriately selected, if necessary, such as antistatic unit, cleaning unit, recycling unit, and controlling unit. Here, the charging unit and the exposing unit may collectively be referred to as a latent image forming unit.

An image forming method according to the present invention includes at least: a charging step, an exposing step, a developing step, a transfer step, and a fixing step, and further includes other steps appropriately selected, if necessary, such as antistatic step, cleaning step, recycling step, and controlling step. Here, the charging step and the exposing step may collectively be referred to as a latent image forming step.

<Latent Image Bearing Member>

The material, shape, structure, size and others of the latent image bearing member (hereunder may be referred to as "electrophotographic photoconductor" or "photoconductor") are not particularly restricted and can be appropriately selected from known ones. A preferable shape thereof is a drum shape, and examples of the material include: inorganic photoconductors such as amorphous silicon and selenium; and organic photoconductors such as polysilane and phthalopolymethine. Among these, amorphous silicon is preferable in view of longer service life.

<Charging Step and Charging Unit>

The charging step is a step of charging the surface of the latent image bearing member and is carried out by the charging unit.

Charging can be carried out by, for example, applying voltage to the surface of a latent image bearing member with a charger.

The charger is not particularly restricted and can be appropriately selected depending on the purpose. Examples thereof include a contact charger which is publicly known itself and has a conductive or semi-conductive roller, a brush, a film, and a rubber blade, and non-contact chargers using corona discharge such as corotron or scorotron.

The charging unit may take any shape, may be a magnetic brush or a fur brush besides a roller, and can be selected in accordance with the specification and form of an electrophotographic image forming apparatus.

The charger is not limited to such a contact type charger but has an advantage that an image forming apparatus that reduces ozone generated from a charger is obtained.

<Exposing Step and Exposing Unit>

The exposing step is a step of exposing the charged latent image bearing member surface and is carried out by the exposing unit.

The exposure can be carried out, for example, by exposing imagewise the surface of the latent image bearing member by the exposing unit.

An optical system in exposure is roughly classified into an analog optical system and a digital optical system. The analog optical system is an optical system of projecting a manuscript directly on a latent image bearing member by an optical system and the digital optical system is an optical system of forming an image by giving image information as an electric signal, converting the electric signal to an optical signal, and exposing an electrophotographic photoconductor.

The exposing unit is not particularly restricted as long as the surface of the latent image bearing member charged by the charging unit can be exposed imagewise to be formed and can be appropriately selected depending on the purpose. Examples thereof include various exposure devices of a reproduction optical system, a rod lens array system, a laser optical system, a liquid crystal shutter optical system, and an LED optical system.

<Developing Step and Developing Unit>

The developing step is a step of forming a visible image by developing an electrostatic latent image with a toner.

The formation of the visible image can be carried out by, for example, developing an electrostatic latent image with the toner and can be carried out by the developing unit.

The developing unit is not particularly restricted as long as development can be carried out, for example, with the toner and can be appropriately selected from known unit. A preferable example thereof is a unit housing the toner and having at least a developing unit capable of giving the toner to an electrostatic latent image in a contact or noncontact manner, and the developing device including a toner container is more preferable.

The developing device may be of either a dry-development type or a wet-development type and may be either a monocolor developing device or a multicolor developing device.

In the developing device, for example, the toner is mixed and stirred, the toner is charged with electricity by friction, they are retained in the state of being in ear on the surface of a rotating magnet roller, and thus a magnetic brush is formed. Since the magnet roller is allocated in the vicinity of the latent image bearing member, a part of the toner constituting the magnetic brush formed on the surface of the magnet roller moves toward the surface of the latent image bearing member by an electrical suction force. As a result, the electrostatic latent image is developed by the toner, and a visible image is formed by the toner on the surface of the latent image bearing member.

<Transfer Step and Transfer Unit>

The transfer step is a step of transferring a visible image to a recording medium. A preferable aspect thereof is to: transfer primarily a visible image on the intermediate transfer member using an intermediate transfer member; and then transfer secondarily the visible image on a recording medium. As the toner, toner of two or more colors or preferably a full-color toner is used. Furthermore, a more preferable aspect thereof is to have a primary transfer step of transferring a visible image on an intermediate transfer member to form a composite transfer image, and a secondary transfer step of transferring the composite transfer image on a recording medium.

The transfer of a visible image can be carried out by, for example, charging a latent image bearing member through the use of a transfer charger and can be carried out by the transfer unit.

Meanwhile, the intermediate transfer member is not particularly restricted and can be appropriately selected from known transfer bodies depending on the purpose. A preferable example thereof is a transfer belt.

The transfer unit (a primary transfer unit and a secondary transfer unit) preferably includes at least a transfer unit that exfoliates and electrically charges a visible image formed on a latent image bearing member to the side of a recording medium. The transfer unit may be one unit or two or more units. Meanwhile, the recording medium is typically ordinary paper but is not particularly restricted as long as it can transfer an image that is not yet fixed after being developed and can be appropriately selected depending on the purpose. A PET base for an OHP can also be used as the recording medium.

<Fixing Step and Fixing Unit>

The fixing step is a step of fixing a toner image transferred to a recording medium, and the toner image can be fixed by the fixing unit. Meanwhile, when a toner of two or more colors is used, an image may be fixed either every time when toner of each color is transferred to a recording medium or in a state of transferring and stacking in layers toner of all colors to a recording medium. The fixing unit is not particularly restricted and can be appropriately selected depending on the purpose. A heat fixing method using a known heating and pressurizing unit can be adopted.

<Other Steps and Other Units>

—Antistatic Step and Antistatic Unit—

The antistatic step is a step of removing static electricity by applying an antistatic bias to the latent image bearing member and can be appropriately carried out by the antistatic unit.

The antistatic unit is not particularly restricted, any unit can be adopted as long as it can apply an antistatic bias to a latent image bearing member, and the antistatic unit can be appropriately selected from known antistatic devices. A preferable example thereof is an antistatic lamp.

—Cleaning Step and Cleaning Unit—

The cleaning step is a step of removing a toner remaining on the latent image bearing member and can be appropriately carried out by the cleaning unit.

The cleaning unit is not particularly restricted, any unit can be adopted as long as it can remove an electrophotographic toner remaining on the latent image bearing member, and the cleaning unit can be appropriately selected from known cleaners. Preferable examples thereof are a magnetic brush cleaner and a blade cleaner.

—Recycling Step and Recycling Unit—

The recycling step is a step of recycling the toner removed at the cleaning step to the developing unit and can be appropriately carried out by the recycling unit.

The recycling unit is not particularly restricted, and an example thereof is a known conveying unit.

—Controlling Step and Controlling Unit—

The controlling step is a step of controlling the above steps and can be appropriately carried out by the controlling unit.

The controlling unit is not particularly restricted as long as it can control the movement of the above units and can be appropriately selected depending on the purpose. Examples thereof include devices such as sequencer and computer.

FIG. 1 illustrates an example of an image forming apparatus of the present invention.

An image forming apparatus 1 of FIG. 1 includes, at a circumference of a drum-shaped electrophotographic photoconductor 3, a charging unit 4, a beam exposure 6 from an image exposing unit which is not illustrated, a process-cartridge type developing unit (developing device) 5, a transfer unit 7, a cleaning unit 8 including a cleaning blade 8*a*, a fixing unit 12 including a heat roller 12*a* and a pressure roller 12*b*.

The developing device 5 is configured with a developing roller 14 and a doctor 17, wherein the developing roller 14 supplies a toner from an opening 20 of a toner container 21 which includes a toner stirring unit 19 to a toner feed roller 18 and guides the layered toner supplied from the toner feed roller 18 to a developing portion, and wherein the doctor 17 is for forming a layer of toner supplied on the developing roller 14. In FIG. 1, reference marks 10 and 8*b* denote a recording medium and a cleaning brush, respectively.

In the image forming apparatus of FIG. 1, a surface of the electrophotographic photoconductor 3 is charged with the roller-shaped charging unit 4, a latent image region is selectively formed by the beam exposure 6 from the image exposure unit, the latent image is developed by the process-cartridge type developing unit 5, the developed toner image is transferred to the recording medium 10 by the transfer unit 7, and the toner image on the recording medium 10 is fixed by the fixing unit 12. Meanwhile, a toner remaining on the electrophotographic photoconductor 3 is cleaned by the cleaning unit 8 and reused similarly in the image forming process.

<Process Cartridge>

A process cartridge used in the present invention has at least a latent image bearing member that supports an electrostatic latent image and a developing unit for developing the electrostatic latent image supported on the latent image bearing member through the use of a toner to form a visible image, and further has other unit such as a charging unit, a developing unit, a transfer unit, a cleaning unit, and an antistatic unit, those being appropriately selected, if necessary.

Preferably, the process cartridge can be detachably attached to each of various electrophotographic image forming apparatuses, a facsimile, and a printer, and further can be detachably attached to an image forming apparatus according to the present invention.

Figure 11:
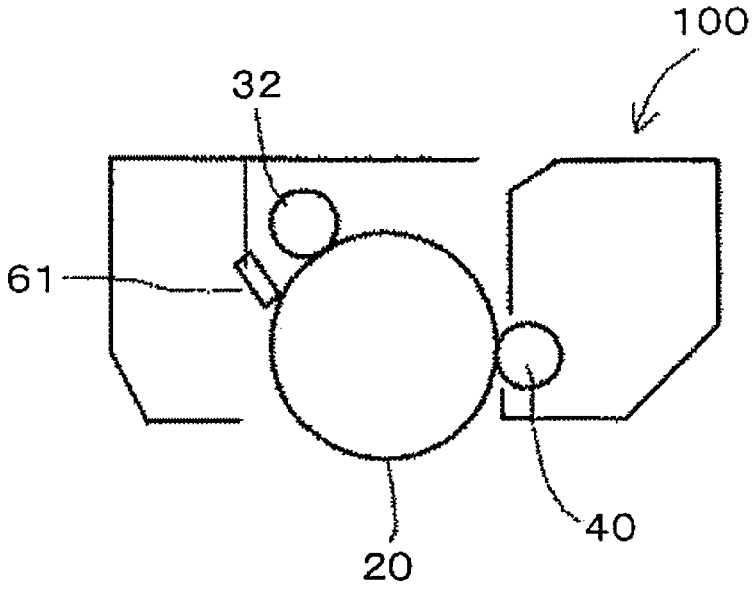
FIG. 11 is a schematic view illustrating an example of a process cartridge.

FIG. 11 is a schematic view illustrating an example of a process cartridge 100.

The process cartridge 100 in FIG. 11 has a latent image bearing member (photoconductor) 20, a proximity-type brush-shaped contact charging unit 32, a developing unit 40 that stores a toner, and a cleaning unit including at least a cleaning blade 61 as a cleaning unit. In the present invention, it is possible to form a process cartridge by integrally combining the above constituent components and configure the process cartridge so as to be detachably attached to an image forming apparatus main body such as copier or printer.

EXAMPLES

Hereinafter, the present invention will be explained in detail on the basis of examples but the present invention is not limited to the examples below.

Example 1

Formation of Elastic Layer

Epichlorohydrin rubber (HYDRIN T3106, manufactured by Zeon Corporation.) was coated on a surface of a metal shaft (iron) having a diameter of 6 mm as a core metal to form an elastic layer having an average thickness of 3 mm.

A surface of the obtained elastic layer was ground against the grain with a grinder (LEO-600-F4L-BME, manufactured by Minakuchi Machinery Works Ltd.) under the following grinding conditions while a grinding time and a grinding angle were adjusted.

Here, "against the grain" means that the direction of rotation during grinding of a core metal on which an elastic layer is formed is opposite from the direction of rotation of the developing roller during developing.

<Preparation of Surface Layer Liquid>

In a mixture solvent including 0.14 parts by mass of methyl ethyl ketone, 2 parts by mass of butyl acetate and 18 parts by mass of ethyl acetate, 1 part by mass of hexamethylenediisocyanate (D170N, manufactured by Mitsui Chemicals, Inc.), 0.14 parts by mass of polyurethane polyol (A2789, manufactured by Mitsui Chemicals, Inc.), and 1.07 parts by mass of Ketjen Black (EC600JD, manufactured by Lion Co., Ltd.) were dissolved, to which 0.02 parts by mass of NEOSTANN U-820 (manufactured by Nitto Kasei Co., Ltd.) was added as a catalyst to form a surface layer liquid.

<Formation of Surface Layer>

The core metal on which the elastic layer was formed was set up in a vertical direction and rotated at 500 rpm against the grain, and the surface layer solution was coated by a spray coating method from a perpendicular direction with respect to the elastic layer. The coated film was thermally cured through annealing treatment at 130° C. for 0.5 hours and then at 145° C. for 1 hour to form a surface layer having an average thickness of 2.5 μm. Accordingly, a developing roller of Example 1 was prepared.

Example 2

Formation of Elastic Layer

Epichlorohydrin rubber (HYDRIN T3106, manufactured by Zeon Corporation.) was coated on a surface of a metal shaft (iron) having a diameter of 6 mm as a core metal to form an elastic layer having an average thickness of 3 mm.

A surface of the obtained elastic layer was ground against the grain with a grinder (LEO-600-F4L-BME, manufactured by Minakuchi Machinery Works Ltd.) under the following grinding conditions while a grinding time and a grinding angle were adjusted.

Here, "against the grain" means that the direction of rotation during grinding of a core metal on which an elastic layer is formed is opposite from the direction of rotation of the developing roller during developing.

<Preparation of Surface Layer Liquid>

In a mixture solvent including 0.14 parts by mass of methyl ethyl ketone, 0.12 parts by mass of PMMA spherical particles (MB30X-5, manufactured by Sekisui Plastics Co., Ltd., having an volume average particle diameter of 5 μm), 2 parts by mass of butyl acetate and 18 parts by mass of ethyl acetate, 1 part by mass of hexamethylenediisocyanate (D170N, manufactured by Mitsui Chemicals, Inc.), 0.14 parts by mass of polyurethane polyol (A2789, manufactured by Mitsui Chemicals, Inc.), and 1.07 parts by mass of carbon black (SHOBLACK N220 manufactured by Cabot Japan Co., Ltd.) were dissolved, to which 0.02 parts by mass of NEOSTANN U-820 (manufactured by Nitto Kasei Co., Ltd.) was added as a catalyst to form a surface layer liquid.

<Formation of Surface Layer>

The core metal on which the elastic layer was formed was set up in a vertical direction and rotated at 500 rpm against the grain, and the surface layer solution was coated by a spray coating method from a perpendicular direction with respect to the elastic layer. The coated film was thermally cured through annealing treatment at 130° C. for 0.5 hours and then at 145° C. for 1 hour to form a surface layer having an average thickness of 2.5 μm. Accordingly, a developing roller of Example 2 was prepared.

Example 3

Formation of Elastic Layer

A mixture of 60% by mass of epichlorohydrin rubber (HYDRIN T3106, manufactured by Zeon Corporation.) and 40% by mass of acrylonitrile butadiene rubber (DN401L, manufactured by Zeon Corporation.) was coated on a surface of a metal shaft (iron) having a diameter of 6 mm as a core metal to form an elastic layer having an average thickness of 3 mm.

A surface of the obtained elastic layer was ground against the grain with a grinder (LEO-600-F4L-BME, manufactured by Minakuchi Machinery Works Ltd.) under the following grinding conditions while a grinding time and a grinding angle were adjusted.

Here, "against the grain" means that the direction of rotation during grinding of a core metal on which an elastic layer is formed is opposite from the direction of rotation of the developing roller during developing.

<Preparation of Surface Layer Liquid>

In a mixture solvent including 0.34 parts by mass of methyl ethyl ketone, 2 parts by mass of butyl acetate and 18 parts by mass of ethyl acetate, 1 part by mass of hexamethylenediisocyanate (D170N, manufactured by Mitsui Chemicals, Inc.), 0.34 parts by mass of polyurethane polyol (A2789, manufactured by Mitsui Chemicals, Inc.), and 1.22 parts by mass of Ketjen Black (EC600JD, manufactured by Lion Co., Ltd.) were dissolved, to which 0.06 parts by mass of NEOSTANN U-820 (manufactured by Nitto Kasei Co., Ltd.) was added as a catalyst to form a surface layer liquid.

<Formation of Surface Layer>

The core metal on which the elastic layer was formed was set up in a vertical direction and rotated at 500 rpm against the grain, and the surface layer solution was coated by a spray coating method from a perpendicular direction with respect to the elastic layer. The coated film was thermally cured through annealing treatment at 130° C. for 0.5 hours and then at 145° C. for 1 hour to form a surface layer having an average thickness of 2.5 μm. Accordingly, a developing roller of Example 3 was prepared.

Example 4

Formation of Elastic Layer

A mixture of 60% by mass of epichlorohydrin rubber (HYDRIN T3106, manufactured by Zeon Corporation.) and 40% by mass of acrylonitrile butadiene rubber (DN401L, manufactured by Zeon Corporation.) was coated on a surface of a metal shaft (iron) having a diameter of 6 mm as a core metal to form an elastic layer having an average thickness of 3 mm.

A surface of the obtained elastic layer was ground against the grain with a grinder (LEO-600-F4L-BME, manufactured by Minakuchi Machinery Works Ltd.) under the following grinding conditions while a grinding time and a grinding angle were adjusted.

Here, "against the grain" means that the direction of rotation during grinding of a core metal on which an elastic layer is formed is opposite from the direction of rotation of the developing roller during developing.

<Preparation of Surface Layer Liquid>

In a mixture solvent including 0.34 parts by mass of methyl ethyl ketone, 0.14 parts by mass of complex spherical particles of melamine and silica (OPTBEADS 3500M, manufactured by Nissan Chemical Industries, Ltd., volume average particle diameter of 3.5 μm), 2 parts by mass of butyl acetate and 18 parts by mass of ethyl acetate, 1 part by mass of hexamethylenediisocyanate (3170N, manufactured by Mitsui Chemicals, Inc.), 0.34 parts by mass of polyurethane polyol (A2789, manufactured by Mitsui Chemicals, Inc.), and 1.22 parts by mass of carbon black (SHOBLACK N330, manufactured by Cabot Japan Co., Ltd.) were dissolved, to which 0.06 parts by mass of NEOSTANN U-600 (manufactured by Nitto Kasei Co., Ltd.) was added as a catalyst to form a surface layer liquid.

<Formation of Surface Layer>

The core metal on which the elastic layer was formed was placed in parallel with the ground, and the surface layer solution was coated by a spray coating method from the longitudinal direction of the core metal on which the elastic layer was formed. The coated roller was rotated against the grain at 600 rpm, and the coated film was thermally cured through annealing treatment at 130° C. for 0.5 hours and then at 145° C. for 1 hour to form a surface layer having an average thickness of 2.5 μm. Accordingly, a developing roller of Example 4 was prepared.

Example 5

Formation of Elastic Layer

A mixture of 50% by mass of epichlorohydrin rubber (CG 102, manufactured by Daiso Co., Ltd.), 40% by mass of chloroprene rubber (WRT, manufactured by Showa Denko K. K.) and 10% by mass of acrylonitrile butadiene rubber (DN3335, manufactured by Zeon Corporation) was coated on a surface of a metal shaft (iron) having a diameter of 6 mm as a core metal to form an elastic layer having an average thickness of 3 mm.

A surface of the obtained elastic layer was ground against the grain with a grinder (LEO-600-F4L-BME, manufactured by Minakuchi Machinery Works Ltd.) under the following grinding conditions while a grinding time and a grinding angle were adjusted.

Here, "against the grain" means that the direction of rotation during grinding of a core metal on which an elastic layer is formed is opposite from the direction of rotation of the developing roller during developing.

<Preparation of Surface Layer Liquid>

In a mixture solvent including 0.14 parts by mass of methyl ethyl ketone, 2 parts by mass of butyl acetate and 18 parts by mass of ethyl acetate, 1 part by mass of hexamethylenediisocyanate (D160N, manufactured by Mitsui Chemicals, Inc.), 0.14 parts by mass of polyurethane polyol (A2789, manufactured by Mitsui Chemicals, Inc.), and 0.32 parts by mass of carbon black (SHOBLACK N220 manufactured by Cabot Japan Co., Ltd.) were dissolved, to which 0.02 parts by mass of NEOSTANN U-820 (manufactured by Nitto Kasei Co., Ltd.) was added as a catalyst to form a surface layer liquid.

<Formation of Surface Layer>

The core metal on which the elastic layer was formed was set up in a vertical direction and rotated at 500 rpm against the grain, and the surface layer solution was coated by a spray coating method from a perpendicular direction with respect to the elastic layer. The coated film was thermally cured through annealing treatment at 130° C. for 0.5 hours and then at 145° C. for 1 hour to form a surface layer having an average thickness of 2.5 μm. Accordingly, a developing roller of Example 5 was prepared.

Example 6

Formation of Elastic Layer

A mixture of 30% by mass of epichlorohydrin rubber (HYDRIN T3106, manufactured by Zeon Corporation.), 60% by mass of chloroprene rubber (WRT, manufactured by Showa Denko K. K.) and 10% by mass of acrylonitrile butadiene rubber (DN2850, manufactured by Zeon Corporation.) was coated on a surface of a metal shaft (iron) having a diameter of 6 mm as a core metal to form an elastic layer having an average thickness of 3 mm.

A surface of the obtained elastic layer was ground against the grain with a grinder (LEO-600-F4L-BME, manufactured by Minakuchi Machinery Works Ltd.) under the following grinding conditions while a grinding time and a grinding angle were adjusted.

Here, "against the grain" means that the direction of rotation during grinding of a core metal on which an elastic layer is formed is opposite from the direction of rotation of the developing roller during developing.

<Preparation of Surface Layer Liquid>

In a mixture solvent including 0.14 parts by mass of methyl ethyl ketone, 2 parts by mass of butyl acetate and 18 parts by mass of ethyl acetate, 1 part by mass of hexamethylenediisocyanate (D127N, manufactured by Mitsui Chemicals, Inc.), 0.14 parts by mass of polyurethane polyol (A2789, manufactured by Mitsui Chemicals, Inc.), and 0.32 parts by mass of Ketjen Black (EC600JD, manufactured by Lion Co., Ltd.) were dissolved, to which 0.02 parts by mass of NEOSTANN U-820 (manufactured by Nitto Kasei Co., Ltd.) was added as a catalyst to form a surface layer liquid.

<Formation of Surface Layer>

The core metal on which the elastic layer was formed was set up in a vertical direction and rotated at 500 rpm against the grain, and the surface layer solution was coated by a spray coating method from a perpendicular direction with respect to the elastic layer. The coated film was thermally cured through annealing treatment at 130° C. for 0.5 hours and then at 145° C. for 1 hour to form a surface layer having an average thickness of 2.5 μm. Accordingly, a developing roller of Example 6 was prepared.

Example 7

Formation of Elastic Layer

A mixture of 60% by mass of epichlorohydrin rubber (HYDRIN T3106, manufactured by Zeon Corporation.) and 40% by mass of acrylonitrile butadiene rubber (DN401L, manufactured by Zeon Corporation.) was coated on a surface of a metal shaft (iron) having a diameter of 6 mm as a core metal to form an elastic layer having an average thickness of 3 mm.

A surface of the obtained elastic layer was ground against the grain with a grinder (LEO-600-F4L-BME, manufactured by Minakuchi Machinery Works Ltd.). Accordingly, a developing roller of Example 7 was prepared.

Here, "against the grain" means that the direction of rotation during grinding of a core metal on which an elastic layer is formed is opposite from the direction of rotation of the developing roller during developing.

Comparative Example 1

Formation of Elastic Layer

A mixture of 60% by mass of epichlorohydrin rubber (HYDRIN T3106, manufactured by Zeon Corporation.) and 40% by mass of acrylonitrile butadiene rubber (DN401L, manufactured by Zeon Corporation.) was coated on a surface of a metal shaft (iron) having a diameter of 6 mm as a core metal to form an elastic layer having an average thickness of 3 mm.

A surface of the obtained elastic layer was ground with the grain with a grinder (LEO-600-F4L-BME and SZC, manufactured by Minakuchi Machinery Works Ltd.). Accordingly, a developing roller of Comparative Example 1 was prepared.

Here, "with the grain" means that the direction of rotation during grinding of a core metal on which an elastic layer is formed is in the same direction as the rotation of the developing roller during developing.

Comparative Example 2

Formation of Elastic Layer

A mixture of 30% by mass of epichlorohydrin rubber (HYDRIN T3106, manufactured by Zeon Corporation.), 60% by mass of chloroprene rubber (WRT, manufactured by Showa Denko K. K.) and 10% by mass of acrylonitrile butadiene rubber (DN2850, manufactured by Zeon Corporation.) was coated on a surface of a metal shaft (iron) having a diameter of 6 mm as a core metal to form an elastic layer having an average thickness of 3 mm.

A surface of the obtained elastic layer was ground with the grain with a grinder (LEO-600-F4L-BME, manufactured by Minakuchi Machinery Works Ltd.) under the following grinding conditions.

Here, "with the grain" means that the direction of rotation during grinding of a core metal on which an elastic layer is formed is in the same direction as the rotation of the developing roller during developing.

<Preparation of Surface Layer Liquid>

In a mixture solvent including 1.47 parts by mass of methyl ethyl ketone, 0.18 parts by mass of PMMA spherical particles (MB30X-5, manufactured by Sekisui Plastics Co., Ltd., having an volume average particle diameter of 5 μm), 2.04 parts by mass of butyl acetate and 18.36 parts by mass of ethyl acetate, 0.5 parts by mass of hexamethylenediisocyanate (D170N, manufactured by Mitsui Chemicals, Inc.), 1.47 parts by mass of polyurethane polyol (A2789, manufactured by Mitsui Chemicals, Inc.), and 1.61 parts by mass of carbon black (SHOBLACK N330 manufactured by Cabot Japan Co., Ltd.) were dissolved, to which 0.06 parts by mass of NEOSTANN U-600 (manufactured by Nitto Kasei Co., Ltd.) was added as a catalyst to form a surface layer liquid.

<Formation of Surface Layer>

The core metal on which the elastic layer was formed was placed in parallel with the ground, and the surface layer solution was coated by a spray coating method from the longitudinal direction of the core metal on which the elastic layer was formed. The coated roller was rotated against the grain at 500 rpm, and the coated film was thermally cured through annealing treatment at 130° C. for 0.5 hours and then at 145° C. for 1 hour to form a surface layer having an average thickness of 2.5 μm. Accordingly, a developing roller of Comparative Example 2 was prepared.

<Surface Shape>

A surface profile of each developing roller was obtained using a laser microscope (VK-9500, manufactured by Keyence Corporation) to measure an average length ($a_2$) of a first inclined surface of concave portions and an average length ($b_2$) of a second inclined surface of concave portions (5 measurement points), which were evaluated on the following basis. The results are shown in Table 1.

A depth of a concave portion (maximum difference in height) and the shortest distance between the centers of adjacent concave portions (pitch) were measured at arbitrarily selected 30 locations, and average values thereof were calculated. The results are shown in Table 1.

[Evaluation Criteria]

A: All the five measurement locations satisfy the condition: $(a_2)<(b_2)$.

B: One or more measurement locations does not satisfy the condition: $(a_2)<(b_2)$.

C: All the five measurement locations do not satisfy the condition: $(a_2)<(b_2)$.

<JIS-A Hardness of Elastic Layer>

A JIS-A hardness of each elastic layer was measured by a type-A durometer in conformity with JIS K6253 "Rubber, vulcanized or thermoplastic-Determination of hardness". The results are shown in Table 1.

TABLE 1

| | Satisfaction level of $(a_2) < (b_2)$ condition | Depth of concave portion (μm) | Shortest distance between centers of adjacent concave portions (μm) | JIS-A hardness of elastic layer |
|---|---|---|---|---|
| Example 1 | A | 15.0 | 157.939 | 30 |
| Example 2 | A | 12.1 | 228.911 | 32 |
| Example 3 | A | 11.6 | 249.342 | 36 |
| Example 4 | A | 12.5 | 103.257 | 41 |
| Example 5 | A | 13.2 | 175.964 | 45 |
| Example 6 | A | 11.1 | 100.985 | 43 |
| Example 7 | A | 14.8 | 200.639 | 42 |
| Comp. Ex. 1 | C | 2.03 | 253.782 | 27 |
| Comp. Ex. 2 | B | 10.7 | 98.438 | 47 |

<Difference of Indentation Power>

Using Dynamic Ultra Micro Hardness Tester (DUH-211, manufactured by Shimadzu Corporation), indentation power was measured at 120 locations with 3 degrees apart on a circumference of a developing roller, which is at a center of the developing roller with respect to a longitudinal direction (around 11 cm from the edge of the developing roller in a longitudinal direction, where the developing roller has a length of 22.9 cm (rubber portion)), and the difference between a maximum value (Max nit) and a minimum value (Min nit) of indentation power it was measured. Here, nit of 100% means the same amount as that indented is restored.

TABLE 2

| | Max ηit (1) | Min ηit (2) | Difference ((1) − (2)) | Average | Standard deviation σ |
|---|---|---|---|---|---|
| Example 1 | 87.937% | 70.098% | 17.839% | 79.520% | 5.709% |
| Example 2 | 85.294% | 64.625% | 20.669% | 76.492% | 6.689% |
| Example 3 | 89.195% | 76.811% | 12.384% | 81.852% | 3.373% |
| Example 4 | 86.291% | 67.575% | 18.716% | 78.049% | 6.017% |
| Example 5 | 86.526% | 74.098% | 12.428% | 80.280% | 3.413% |
| Example 6 | 84.638% | 69.704% | 14.934% | 78.098% | 4.568% |
| Example 7 | 92.537% | 82.175% | 10.362% | 86.484% | 3.154% |
| Comp. Ex. 1 | 91.674% | 86.428% | 5.246% | 88.918% | 1.532% |
| Comp. Ex. 2 | 80.138% | 55.201% | 24.937% | 68.770% | 7.761% |

[Evaluation with Actual Equipment (i)]

Apparatus used: image forming apparatus IPSIO SP C310 manufactured by Ricoh Company, Ltd.

Toner used: genuine toner manufactured by Ricoh Company, Ltd. which came with IPSIO SP C310

Evaluation method: in an N-N environment (23° C., 45% RH), a duration test was performed up to continuous 3,000 sheets using a vertical band chart having a width of 6 mm. A check point was allocated at every 1,000 sheet, and an amount of toner consumed from the initial amount was additionally supplied. After duration of 3,000 sheets, a half-tone image was printed. Presence or absence of white streaks were observed and evaluated on the following basis. The results are shown in Table 3.

TABLE 3

| | Evaluation Result | Evaluation Criteria |
|---|---|---|
| Example 1 | A | A: favorable image with no white streak |
| Example 2 | A | B: satisfactory image in terms of quality with one white streak |
| Example 3 | A | C: no-good image in terms of quality with a plurality of white streaks |
| Example 4 | A | |
| Example 5 | A | |
| Example 6 | A | |
| Example 7 | A | |
| Comp. Ex. 1 | B | |
| Comp. Ex. 2 | C | |

[Evaluation with Actual Equipment (ii)]

Apparatus used: image forming apparatus IPSIO SP C310 manufactured by Ricoh Company, Ltd.

Toner used: genuine toner manufactured by Ricoh Company, Ltd. which came with IPSIO SP C310

Evaluation method: in an H-H environment (27° C., 80% RH), a duration test was performed up to continuous 5,000 sheets using a vertical band chart having a width of 6 mm. A check point was allocated at every 1,000 sheet, where an amount of the toner thin layer on the developing roller, M/A, was measured. Changes in the value of M/A associated with duration was tracked and evaluated on the following basis. Here, an amount of toner consumed from the initial amount was additionally supplied. The results are shown in Table 4.

The amount of a toner thin layer on the developing roller, M/A, was measured as follows. A uniform toner thin layer was formed on a surface of the developing roller. This toner thin layer was drawn off using a compact draw-off charge measurement apparatus (MODEL 210HS, manufactured by Trek Japan K. K.). The area from which the toner thin layer was drawn off was measured, and an amount of conveyed toner per unit area was obtained.

TABLE 4

| | Evaluation Result | Evaluation Criteria |
|---|---|---|
| Example 1 | A | Change in an amount of M/A after duration of 5,000 sheets from the initial amount is: |
| Example 2 | A | A: 0% to 10% |
| Example 3 | B | B: 11% to 20% |
| Example 4 | B | C: 21% to 50% |
| Example 5 | B | D: 51% or greater |
| Example 6 | B | |
| Example 7 | B | |
| Comp. Ex. 1 | D | |
| Comp. Ex. 2 | C | |

Aspects of the present invention are as follows.

<1> A developing roller including:

a core metal, and an elastic layer formed on an outer circumference of the core metal, wherein an outermost surface of the developing roller is roughened, and wherein a difference between a maximum value and a minimum value of indentation power is 10% to 21%, wherein the indentation power is measured by a micro-indentation test at 120 locations with 3 degrees apart on a circumference of the developing roller, which is at a center of the developing roller with respect to a longitudinal direction.

<2> The developing roller according to <1>, wherein the outermost surface of the developing roller observed from a cross-section perpendicular to an axis direction of the core metal includes a plurality of concave portion with respect to the outermost surface, wherein, in at least two of the concave portions adjacent to each other, a first inclined surface and a second inclined surface which is larger than the first inclined surface are alternatively and iteratively allocated, and wherein an average length of the first inclined surface is shorter than an average length of the second inclined surface.

<3> The developing roller according to <2>, wherein the first inclined surface in the concave portion is on an upstream side with respect to a rotating direction of the developing roller, and the second inclined surface in the concave portion is on a downstream side with respect to the rotating direction of the developing roller.

<4> The developing roller according to any one of <2> to <3>, wherein an average value of a shortest distance between centers of the concave portions adjacent to each other is 100 μm to 250 μm, and wherein an average value of a depth of the concave portions is 11.0 μm to 15.0 μm.

<5> The developing roller according to any one of <1> to <4>, wherein the elastic layer has a JIS-A hardness of 30° to 45°.

<6> The developing roller according to any one of <1> to <5>, wherein the developing roller further includes a surface layer on the elastic layer, and wherein the surface layer includes organic spherical particles.

<7> The developing roller according to <6>, wherein the organic spherical particles have a volume average particle size of 3 μm to 10 μm.

<8> A developing device, including: a developing roller configured to bear on a surface thereof a toner to be supplied to a latent image bearing member; a toner supplying member configured to supply the toner onto the surface of the developing roller; a toner layer regulating member configured to form a thin layer of the toner on the surface of the developing roller, and a toner container which houses the toner, wherein the developing roller is the developing roller according to any one of <1> to <7>.

<9> An image forming apparatus, including;

a latent image bearing member;

a charging unit configured to charge a surface of the latent image bearing member;

an exposing unit configured to expose the charged surface of the latent image bearing member to light to form an electrostatic latent image;

a developing unit configured to develop the electrostatic latent image with a toner to form a visible image;

a transfer unit configured to transfer the visible image to a recording medium; and a fixing unit configured to fix the transferred image on the recording medium, wherein the developing unit is the developing device according to <8>.

<10> A process cartridge, including;

a latent image bearing member; and a developing unit configured to develop an electrostatic latent image on the latent image bearing member with a toner to form a visible image, wherein the process cartridge is detachably mounted to the main body of an image forming apparatus, and wherein the developing unit is the developing device according to <8>.

<11> A method for forming an image, the method including;

charging a surface of a latent image bearing member;

exposing the charged surface of the latent image bearing member to light to form an electrostatic latent image;

developing the electrostatic latent image with a toner to form a visible image;

transferring the visible image to a recording medium; and fixing the transferred image on the recording medium, wherein the developing is performed by the developing device according to <8>.

This application claims priority to Japanese application No. 2011-191935, filed on Sep. 2, 2011 and incorporated herein by reference.

What is claimed is:

1. A developing roller, comprising:

a core metal; and an elastic layer formed on an outer circumference of the core metal, wherein an outermost surface of the developing roller is roughened, and wherein a difference between a maximum value and a minimum value of an indentation power of the outermost surface is 10% to 21%, wherein the indentation power is measured by a micro-indentation test at 120 locations spaced 3 degrees apart on a circumference of the developing roller, which is at a center of the developing roller with respect to a longitudinal direction.

2. The developing roller according to claim 1, wherein the outermost surface of the developing roller observed from a cross-section perpendicular to an axis direction of the core metal comprises a plurality of concave portions with respect to the outermost surface, wherein, in at least two of the concave portions adjacent to each other, a first inclined surface and a second inclined surface which is larger than the first inclined surface are alternatively and iteratively allocated, and wherein an average length of the first inclined surface is shorter than an average length of the second inclined surface.

3. The developing roller according to claim 2, wherein the first inclined surface in the concave portion is on an upstream side with respect to a rotating direction of the developing roller, and the second inclined surface in the concave portion is on a downstream side with respect to the rotating direction of the developing roller.

4. The developing roller according to claim 2, wherein an average value of a shortest distance between centers of the concave portions adjacent to each other is 100 μm to 250 μm, and wherein an average value of a depth of the concave portions is 11.0 μm to 15.0 μm.

5. The developing roller according to claim 1, wherein the elastic layer has a JIS-A hardness of 30° to 45°.

6. The developing roller according to claim 1, wherein the developing roller further comprises a surface layer on the elastic layer, and wherein the surface layer comprises organic spherical particles.

7. The developing roller according to claim 6, wherein the organic spherical particles have a volume average particle size of 3 μm to 10 μm.

8. The developing roller according to claim 1, wherein the outermost surface of the developing roller observed from a cross-section perpendicular to an axis direction of the core metal comprises a plurality of concave portions with respect to the outermost surface, wherein, a first inclined surface of at least one of the concave portions, which is on an upstream side with respect to a rotating direction of the developing roller, includes a step between ends of the first inclined surface.

9. The developing roller according to claim 1, wherein the outermost surface of the developing roller observed from a cross-section perpendicular to an axis direction of the core metal comprises a plurality of concave portions with respect to the outermost surface, wherein, at least one of the concave portions is formed by two curved surfaces that join one another at a root of the at least one of the concave portions, and one of the two curved surfaces is a convex surface, and the other of the two curved surfaces is a concave surface.

10. The developing roller according to claim 1, wherein the developing roller further comprises a surface layer on the elastic layer, and the surface layer includes a region of low elasticity and a region of high elasticity.

11. The developing roller according to claim 1, wherein the developing roller further comprises a surface layer on the elastic layer, and the surface layer includes various thicknesses.

12. The developing roller according to claim 11, wherein the surface layer includes a lower thickness at a crest region of the surface layer and a higher thickness at a trough region of the surface layer.

13. A developing device, comprising:

a developing roller configured to bear on a surface thereof a toner to be supplied to a latent image bearing member;

a toner supplying member configured to supply the toner onto the surface of the developing roller;

a toner layer regulating member configured to form a thin layer of the toner on the surface of the developing roller, and a toner container which houses the toner, wherein the developing roller comprises: a core metal; and an elastic layer formed on an outer circumference of the core metal, wherein an outermost surface of the developing roller is roughened, and wherein a difference between a maximum value and a minimum value of indentation power of the outermost surface is 10% to 21%, wherein the indentation power is measured by a micro-indentation test at 120 locations spaced 3 degrees apart on a circumference of the developing roller, which is at a center of the developing roller with respect to a longitudinal direction.

14. An image forming apparatus, comprising:

a latent image bearing member;

a charging unit configured to charge a surface of the latent image bearing member;

an exposing unit configured to expose the charged surface of the latent image bearing member to light to form an electrostatic latent image;

a developing unit configured to develop the electrostatic latent image with a toner to form a visible image;

a transfer unit configured to transfer the visible image to a recording medium; and a fixing unit configured to fix the transferred image on the recording medium, wherein the developing unit is the developing device according to claim 13.

* * * * *